United States Patent [19]

Yokoi

[11] Patent Number: 4,544,936

[45] Date of Patent: Oct. 1, 1985

[54] HEAT-SENSITIVE RECORDING SHEET

[75] Inventor: Naoki Yokoi, Ebina, Japan

[73] Assignee: Fuji Xerox Co., Ltd., Tokyo, Japan

[21] Appl. No.: 499,663

[22] Filed: May 31, 1983

[30] Foreign Application Priority Data

May 28, 1982 [JP] Japan ..... 57-90812

[51] Int. Cl.[4] ..... B41M 5/18

[52] U.S. Cl. ..... 346/209; 346/208; 346/217; 346/221; 427/151

[58] Field of Search ..... 282/27.5; 427/150–153; 428/320.4–320.8, 411, 488, 537, 913, 914; 346/204, 208, 209, 216, 217, 221

[56] References Cited

FOREIGN PATENT DOCUMENTS 6162690 12/1981 Japan ..... 346/221

0029492 2/1982 Japan ..... 346/221

*Primary Examiner*—Bruce H. Hess

*Attorney, Agent, or Firm*—Murray, Whisenhunt and Ferguson

[57] ABSTRACT

A heat-sensitive recording sheet is disclosed, comprising a base having thereon a heat-sensitive layer which contains, as main components, at least two kinds of fluoran dye color formers selected from different groups and a developer which causes coloration of the color former by heating. The color image of the heat-sensitive recording sheet fades less under influence of heat or humidity. Further the heat-sensitive recording sheet has high whiteness and less fogging of the background.

21 Claims, No Drawings

HEAT-SENSITIVE RECORDING SHEET

FIELD OF THE INVENTION

The present invention relates to a heat-sensitive recording sheet and, in particular, to an improvement of heat-sensitive recording sheets comprising a heat-sensitive layer on a base where the heat-sensitive layer which contains, as main components, a color former and a developer which colors the color former upon heating of the recording sheet.

BACKGROUND OF THE INVENTION

Heat-sensitive recording sheets are used, for example, in facsimile receivers and printers. Such sheets contain, as main components, a heat-sensitive layer containing a color former and a developer. The heat-sensitive recording sheet is imagewise heated by, for example, a heat generation element such as a thermal head to carry out image recording by a thermal color forming reaction of the color former and the developer.

Hitherto, heat-sensitive recording sheeets have been prepared by applying an aqueous dispersion of a mixture of a colorless or light colored color former such as Crystal Violet lactone, etc. and a developer such as a phenolic compound, etc. to a paper or plastic film as the base and drying the applied dispersion to form a heat-sensitive layer. Further, the recording layer often contains various additives such as wax particles, wax emulsions, fatty acid metal salts, fatty acid amides, etc. for the purpose of improving color forming characteristics, pressure-sensitive color forming properties, lubrication properties, etc. or contains white pigments such as clay, talc, titanium oxide, etc. for the purpose of improving whiteness or writability of the surface of recording layer. Such heat-sensitive recording sheets are described in, for example, U.S. Pat. No. 4,265,978.

The foregoing heat-sensitive recording sheets form a color image on the heated part when imagewise heated by a heating element. However, the color image discolors or fades with heat or humidity. Moreover, the image fades after several days even at a room temperature, if touched 2 or 3 times by the fingers. Consequently, it becomes impossible to read the letters. Various attempts for preventing the fading phenomenon have been tried, as described in U.S. Pat. No. 4,255,491. For example, heat-sensitive recording sheets comprising 3-diethylamino-6-methyl-7-anilinofluoran or 3-pyrrolidino-6-methyl-7-anilinofluoran as the color former are known to minimize stains caused by heat or humidity. However, such heat-sensitive recording sheets have other faults in that they have low whiteness and the background thereof is easily fogged.

OBJECTS OF THE INVENTION

An object of the present invention is to provide a heat-sensitive recording sheet which overcomes the above described prior art faults. Another object of the present invention is to provide a heat-sensitive recording sheet, the color image of which fades less under the influence of heat or humidity and which has high whiteness and less fogging of the background.

DETAILED DESCRIPTION OF PREFERRED EMBODIMENTS OF THE IVENTION

The objects of the present invention can be attained by using a mixture of at least one compound (A) selected from compounds represented by the following formulas (I) or (II) and at least one compound (B) selected from compounds represented by the following formulas (III) or (IV) as a color former used in the heat-sensitive recording layer.

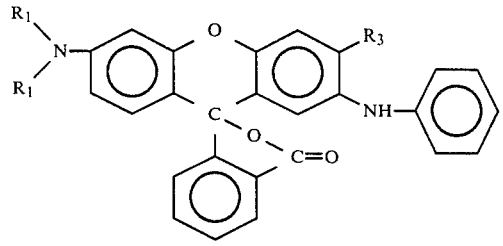

(I)

(wherein $R_1$ represents a hydrogen atom, a methyl group, an ethyl group, a halogenated methyl group, a halogenated ethyl group, an alkoxyalkyl group preferably having 2 to 12 carbon atoms (e.g., $-C_2H_5OCH_3$), an acyloxyalkyl group preferably having 3 to 13 carbon atoms (e.g., $-CH_3OCOCH_3$), an allyl group, a propargyl group, a cyclohexyl group, an acetoxy group, a benzyl group which may be substituted by a lower alkyl group preferably having 1 to 6 carbon atoms, a lower alkoxy group preferably having 1 to 6 carbon atoms, a halogen atom or a nitro group, or a phenyl group which may be substituted by a lower alkyl group preferably having 1 to 6 carbon atoms, a lower alkoxy group preferably having 1 to 6 carbon atoms, a halogen atom or a nitro group, and $R_3$ represents a hydrogen atom, a lower alkyl group preferably having 1 to 6 carbon atoms (e.g., $-C_3H_7$), an alkoxy group preferably having 1 to 12 carbon atoms (e.g., $-OC_2H_5$), an aryl group, a halogen atom, a halogenated lower alkyl group preferably having 1 to 6 carbon atoms (e.g., $-C_3H_6Cl$) or an acetoxy group),

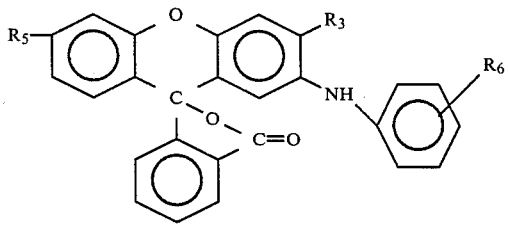

(II)

(wherein $R_3$ is as defined above, $R_5$ represents a pyrrolidino group or a piperidino group, and $R_6$ represents a hydrogen atom, a lower alkyl group preferably having 1 to 6 carbon atoms (e.g., $-C_3H_7$), an alkoxy group preferably having 1 to 12 carbon atoms (e.g., $-OC_2H_5$) or a halogen atoms),

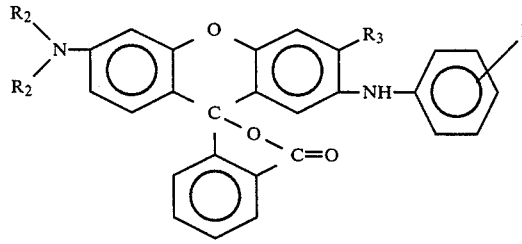

(III)

(wherein $R_3$ is as defined above, $R_2$ represents a hydrogen atom, a lower alkyl group preferably having 1 to 6 carbon atoms (e.g., —$C_3H_7$), a haloalkyl group preferably having 1 to 12 carbon atoms (e.g., —$C_6H_{10}I$), an alkoxyalkyl group preferably having 2 to 12 carbon atoms (e.g., —$C_2H_5OCH_3$), an acyloxyalkyl group preferably having 3 to 13 carbon atoms (e.g., —$CH_3OCOCH_3$), an alkoxy group preferably having 1 to 12 carbon atoms (e.g., —$OC_2H_5$), an allyl group, a propargyl group, a cyclohexyl group, a benzyl group which may be substituted by a lower alkyl group preferably having 1 to 6 carbon atoms, a lower alkoxy group preferably having 1 to 6 carbon atoms, a halogen atom or a nitro group, or a phenyl group which may be substituted by a lower alkyl group preferably having 1 to 6 carbon atoms, a lower alkoxy group preferably having 1 to 6 carbon atoms, a halogen atom or a nitro group, and $R_7$ represents a lower alkyl group preferably having 1 to 6 carbon atoms (e.g., —$C_3H_7$), an alkoxy group preferably having 1 to 12 carbon atoms (e.g., —$OC_2H_5$) or a halogen atom), and

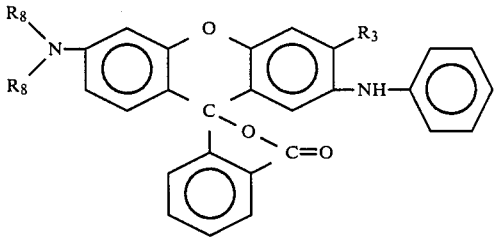

(IV)

(wherein $R_3$ is as defined above, and $R_8$ represents an alkyl group having 3 or more carbon atoms, preferably not more than 12 carbon atoms (e.g., —$C_{10}H_{21}$), or a halogenated alkyl group having 3 or more carbon atoms, preferably not more than 12 carbon atoms (e.g., —$C_3H_6Cl$).

These compounds are generally called fluoran dyes. In the present invention, at least two kinds of fluoran dyes selected from different groups are used as the color former.

Further, a mixture of three kinds of fluoran dyes may be used as the color former by mixing a fluoran dye compound (C) represented by the following formula (V) with the above described two kinds of fluoran dye compounds (A) and (B).

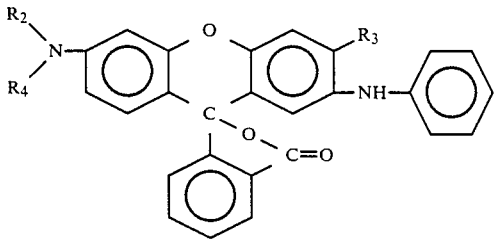

(V)

(wherein $R_2$ and $R_3$ are as defined above and $R_4$ represents a substituent selected from the the same group as described above for $R_2$, but is a substituent different than the $R_2$ substituent in the formula (V)).

Examples of fluoran dyes represented by the formulas (I)-(V) include the following:

Fluoran dyes represented by the formula (I)

3-Dimethylamino-7-anilinofluoran.

-continued

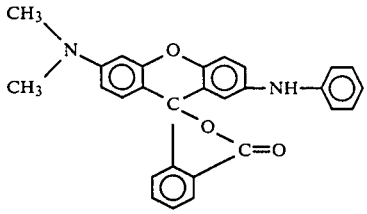

3-Diethylamino-6-methyl-7-anilinofluoran.

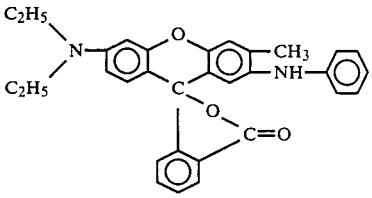

3-Dibenzylamino-6-chloro-7-anilinofluoran.

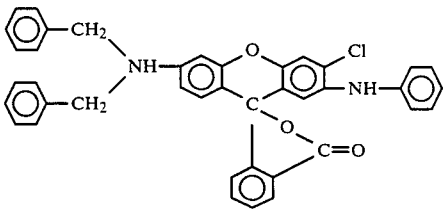

3-Dicyclohexylamino-6-ethyl-7-anilinofluoran.

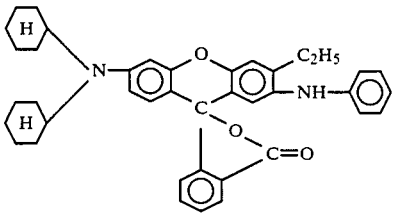

3-Diacetoxyamino-6-bromo-7-anilinofluoran.

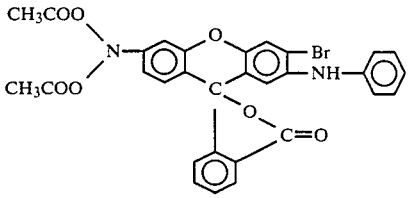

Fluoran dyes represented by the formula (II)

3-Pyrrolidino-6-methyl-7-anilinofluoran.

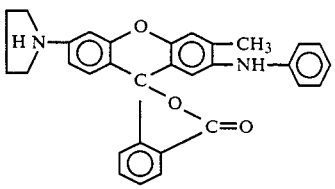

3-Piperidino-6-methyl-7-anilinofluroan.

-continued

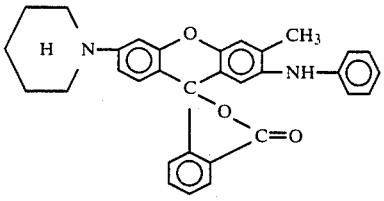

3-Pyrrolidino-6-bromo-7-p-methylanilinofluoran.

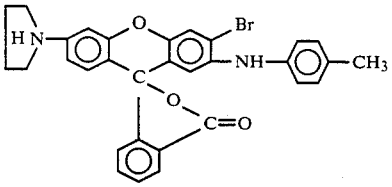

3-Piperidino-6-methoxy-7-p-chloroanilinofluoran.

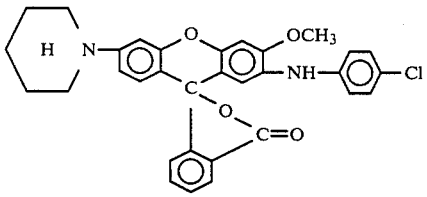

Fluoran dyes represented by the formula (III)

3-Dimethylamino-6-chloroethyl-7-m-bromoanilinofluoran.

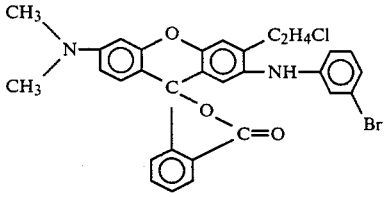

3-Diethylamino-7-o-chloroanilinofluoran.

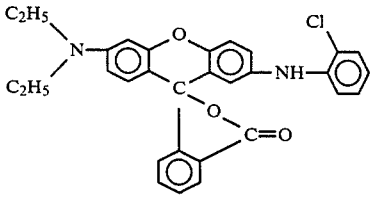

3-Dicyclohexylamino-6-methyl-7-m-methylanilinofluoran.

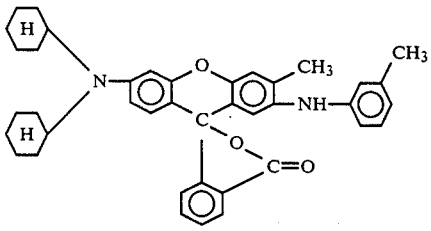

3-Diphenylamino-6-acetoxy-7-m-methoxyanilinofluoran.

-continued

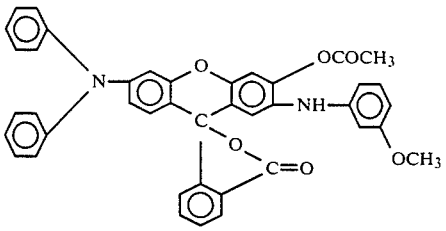

Fluoran dyes represented by the formula (IV)

3-Di-n-propylamino-7-anilinofluoran.

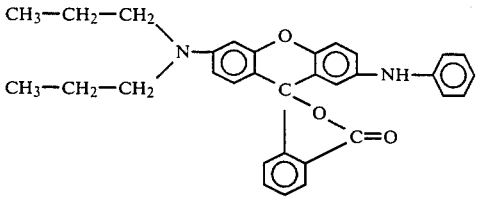

3-Diisopropylamino-6-methyl-7-anilinofluoran.

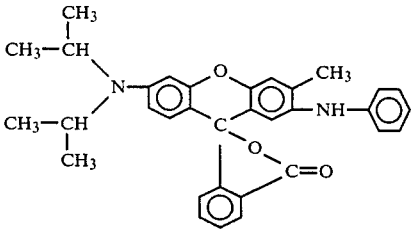

3-Di-n-butylamino-7-anilinofluoran.

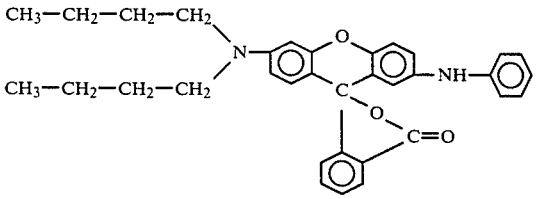

3-Diisobutylamino-6-bromo-7-anilinofluoran.

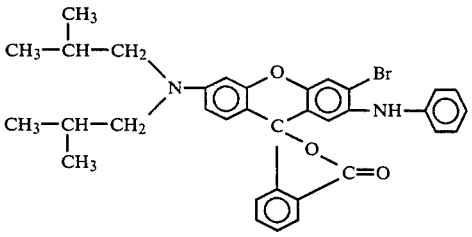

3-Di-n-butylamino-6-methyl-7-anilinofluoran.

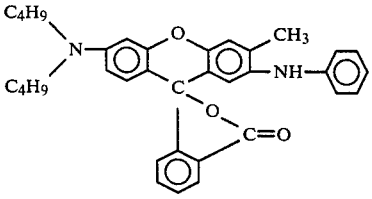

Fluoran dyes represented by the formula (V)

3-Methylethylamino-6-chloro-7-anilinofluoran.

-continued

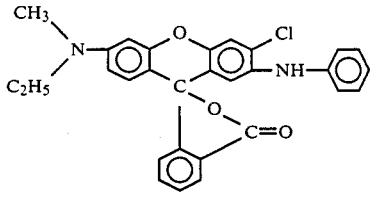

3-Methylcyclohexylamino-6-methyl-7-anilinofluoran.

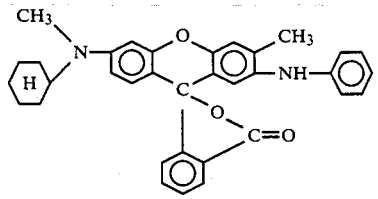

3-Ethoxypropylamino-6-methoxy-7-anilinofluoran.

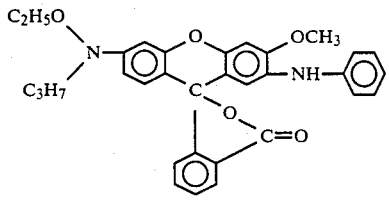

3-m-Chlorobenzylmethylamino-6-phenyl-7-anilinofluoran.

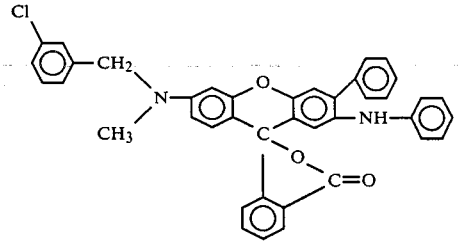

3-p-Nitrophenylamino-6-chloromethyl-7-anilinofluoran.

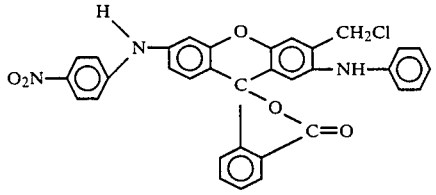

When at least two kinds of compounds consisting of the compound (A) selected from the first group consisting of compounds represented by the formulas (I) and (II) and the compound (B) selected from the second group consisting of compounds represented by the formulas (III) and (IV) are used as the color formers, they are preferably used as a mixture in amounts of 1 to 50% by weight, preferably 20 to 40% by weight, of the compound (A) and 50 to 99% by weight, preferably 60 to 80% by weight, of the compound (B) based on the total amount of the color formers.

Further, when at least one kind of compound (C) represented by the formula (V) is used together with the compound (A) and the compound (B), they are preferably used as a mixture in amounts of 30 to 90% by weight, preferably 35 to 65% by weight, of the compound (A), 2.5 to 30% by weight, preferably 10 to 25% by weight, of the compound (B) and 2.5 to 40% by weight, preferably 25 to 40% by weight, of the compound (C) based on the total amount of the color former by weight.

The developer used in the present invention is an acid substance which causes coloration of the above described fluoran dyes when heated. As such acid substances, there are phenolic compounds and colorless solid organic acids which liquefy or volatilize at 50° C. or more, such as stearic acid, benzoic acid, gallic acid, salicyclic acid, etc. or metal salts thereof, such as aluminium salts, zinc salts, etc. The acid substances capable of preferably being used include the above described phenolic compounds and benzoic acid esters. Typical examples of the phenolic compounds include 4,4'-isoproylidenediphenol (bisphenol A), 4,4'-isopropylidene-bis(2-chlorophenol), 4,4'-isopropylidene-bis(2-tert-butylphenol), 4,4'-sec-butylidenediphenol, 4,4'-cyclohexylidenediphenol, 4,4'-isopropylidene-bis(2,6-dibromophenol), 4,4'-isopropylidene-bis(2,6-dichlorophenol), 4,4'-isopropylidenebis(2-methylphenol), 4,4'-isopropylidene-bis(2,6-dimethylphenol), 4,4'-sec-butylidene-bis(2-methylphenol), 4,4'-cyclohexylidene-bis(2-methylphenol), 4,4'-methylene-bis(2,6-di-tert-butylphenol), 4,4'-butylidene-bis(4-methyl-6-tert-butylphenol) and 4,4'-thiobis(4-methyl-6-tert-butylphenol). Examples of the benzoic acid esters include esters of 4-hydroxybenzoic acid or 3-chloro-4-hydroxybenzoic acid such as benzyl, p-chlorobenzyl, ethyl, propyl, isopropyl, butyl, isobutyl, methylbenzyl ester, and phthalic acid monoanilido 4-ethoxybenzoic acid. Further, the phenolic compounds and the benzoic acid esters may be used together.

Further, additives may be added to the heat-sensitive color forming layer in order to improve various properties. As additives for further improving fading or fogging of the background during storage, there are rosin-modified phenol resins and/or terephthalic acid ester compounds. The rosin-modified phenol resins are commercially available under Tamanol 135, 135F, 145, 340, 350, 351, 352, 353, 354 and 361 produced by Arakawa Rinsan Co. Examples of the terephthalic acid esters include dimethyl terephthalate, diethyl terephthalate, monoethyl terephthalate, diisopropyl terephthalate, monopropyl terephthalate, dibutyl terephthalate, monobutyl terephthalate, di-tert-butyl terephthalate, monooctyl terephthalate, bis-(3,5,5-trimethylhexyl)-terephthalate, dimethyl 2-methoxyterephthalate, dimethyl 2-methylterephthalate, dimethyl 2-chloroterephthalate, dimethyl 2,5-dichloroterephthalate, diethyl 2-chloro-5-bromoterephthalate, dimethyl tetrachloroterephthalate, diphenyl terephthalate, etc.

These additives are preferably added as a mixture of at least two components consisting of at least one kind of a rosin-modified phenol resin and at least one kind of a terephthalic acid ester compound.

Further, in order to prevent adhesion of dregs to the facsimile head, inorganic or organic pigments, binders and other additives such as surface active agents, waxes, etc. may be used. As these additives, known additives may be used. Examples of the pigments include aluminium hydroxide, heavy and light calcium carbonate, zinc oxide, titanium oxide, barium sulfate, silica gel, activated clay, talc, clay, titanium white, kaolinite, calcined kaolinite, diatom earth, synthetic kaolinite, polyolefin particles, polystyrene particles, ureaformaldehyde resin particles, etc.

Examples of the binders may include casein, styrene-maleic acid anhydride resin, polyvinyl alcohol, modified polyvinyl alcohol, starch, modified starch, isobutylene-maleic acid anhydride resin, diisobutylenemaleic acid anhydride resin, polyacrylamide, modified polyacrylamide, carboxymethyl cellulose, methyl vinyl ether-maleic acid copolymer, hydroxyethyl cellulose, hydroxypropyl cellulose, carboxyl modified polyethylene, methyl cellulose, gum arabic, gelatin, polyvinylpyrrolidone, polyacrylic acid salt, terpene resin, petroleum resin, etc. A binder capable of particularly suitable use in the present invention is a water soluble binder, a typical example of which may be polyvinyl alcohol.

As the surface active agents, nonionic and anionic types may be used. Ampholytic agents and cationic agents are not generally used, because some of them cause aggregation of the coating solution.

Further, as the waxes, it is possible to use stearic acid amide, palmitic acid amide, oleic acid amide, lauric acid amide, ethylenebisstearoamide, methylenebisstearoamide, methylol stearoamide, paraffin wax, higher alcohols and higher resin acids.

In addition, it is possible to add fatty acid metal salts such as calcium stearate as a lubricant.

These materials used for the heat-sensitive color forming layer are applied as a mixed aqueous dispersion to a base such as paper, plastic film, etc. The mixed dispersion may be prepared using 15 to 25% by weight of the color former, 25 to 35% by weight of the developer, 15 to 20% by weight of the binder and 10 to 20% by weight of the pigment, based on the total weight of the components for the color forming layer (solid basis). When the rosin-modified phenol resins and/or the terephthalic acid esters are used for improving fading or fogging as described above, they may be added in an amount of 1 to 10% by weight. Further, the surface active agents, the waxes and the fatty acid metal salts may be added in the total amount of 5 to 15% by weight.

This mixed aqueous dispersion is applied to a base by a known process such as an air knife coating process, a bar coating process, a roll coating process, a kiss coating process, etc., and dried to obtain the heat-sensitive recording sheet of the present invention. The coating is carried out so that the dry weight may be 3 to 12 g/m$^2$, preferably 5 to 8 g/m$^2$.

This heat-sensitive recording sheet is imagewise heated by a heating element such as a thermal head to cause color formation, by which image recording can be carried out.

The recording sheet having a heat-sensitive recording layer containing the color former of the present invention and the developer which causes coloration of the color former by heating has such characteristics that fading of the color image due to temperature or humidity is remarkably reduced. Moreover, the whiteness is high and the fogging of the texture or background is small. Further, the recording sheet has high stability to barely cause a change of whiteness of the texture even when the sheet is stored for a long time. Further, the image does not fade even if animal or vegetable oils, cosmetics or oils from the fingers adhere to the image on the recording sheet.

In the following, the heat-sensitive recording sheet of the present invention is illustrated with reference to examples and comparative examples, but the present invention is not limited to these examples.

EXAMPLES

The following dispersions A-I were prepared as base dispersions of heat-sensitive coatings.

Dispersion A:
- 3-Diethylamino-6-methyl-7-anilinofluoran: 150 g
- 5% aqueous solution of PVA (polyvinyl alcohol): 150 g
- Water: 450 g The mixture was blended and dispersed by a ball mill for 48 hours.

Dispersion B:
- 3-N-Methylcyclohexylamino-6-methyl-7-anilinofluoran: 150 g
- 5% aqueous solution of PVA: 150 g
- Water: 450 g The mixture was blended and dispersed by a ball mill for 48 hours.

Dispersion C:
- 3-Pyrrolizino-6-methyl-7-anilinofluoran: 150 g
- 5% aqueous solution of PVA: 150 g
- Water: 450 g The mixture was blended and dispersed by a ball mill for 48 hours.

Dispersion D:
- 3-Diethylamino-7-o-chloroanilinofluoran: 150 g
- 5% aqueous solution of PVA: 150 g
- Water: 450 g The mixture was blended and dispersed by a ball mill for 48 hours.

Dispersion E:
- 3-Di-n-butylamino-6-methyl-7-anilinofluoran: 150 g
- 5% aqueous solution of PVA: 150 g
- Water: 450 g The mixture was blended and dispersed by a ball mill for 48 hours.

Dispersion F:
- Benzyl p-hydroxybenzoate: 150 g
- Stearic acid amide: 50 g
- Zinc stearate: 50 g
- 5% aqueous solution of PVA: 200 g
- Water: 300 g The mixture was blended and dispersed by a ball mill for 24 hours.

Dispersion G:
- Bisphenol A: 150 g
- Stearic acid amide: 50 g
- Zinc stearate: 50 g
- 5% aqueous solution of PVA: 200 g
- Water: 300 g The mixture was blended and dispersed by a ball mill for 24 hours.

Dispersion H:
- 150 g of water-insoluble rosin-modified phenol resin having a softening point of 80° to 190° C., 150 g of 5% aqueous solution of PVA and 200 g of water were dispersed by a ball mill for 24 hours.

Dispersion I:
- 80 g of terephthalic acid ester, 500 g of 5% aqueous solution of PVA and 100 g of water were dispersed by a ball mill for 48 hours.

Using the above described dispersions, calcium carbonate and 5% PVA, heat-sensitive coating for Examples 1–8 and Comparative Examples 1–7 having compositions shown in Table 1 were prepared.

Rosin-modified phenol resins and terephthalic acid esters used in Dispersions H and I in Table 1 are shown in Table 2.

TABLE 1

| | Example | | | | | | | | Comparative Example | | | | | | |
|---|---|---|---|---|---|---|---|---|---|---|---|---|---|---|---|
| | 1 | 2 | 3 | 4 | 5 | 6 | 7 | 8 | 1 | 2 | 3 | 4 | 5 | 6 | 7 |
| Dispersion (g) | | | | | | | | | | | | | | | |
| A | 10 | 11 | — | 10 | — | — | — | — | 20 | 10 | — | — | — | — | — |
| B | 6 | 6 | — | 7 | 7 | — | — | 1 | — | 10 | 10 | — | 20 | — | — |
| C | — | — | 10 | — | 9 | 3 | 2 | 3 | — | — | — | — | — | 10 | — |
| D | 4 | — | 10 | — | — | 7 | 8 | 6 | — | — | 10 | — | — | — | 10 |
| E | — | 3 | — | 3 | 4 | — | — | — | — | — | — | 20 | — | — | — |
| F | 30 | 30 | 30 | 25 | 30 | — | — | — | 30 | 30 | 30 | — | — | — | — |
| G | — | — | — | 5 | — | 50 | 50 | 50 | — | — | — | 40 | 40 | 50 | 50 |
| H | — | — | — | — | — | 20 | 18 | 12 | — | — | — | — | — | — | — |
| I | — | — | — | — | — | 8 | 10 | 16 | — | — | — | — | — | — | — |
| Calcium Carbonate (g) | 4 | 4 | 4 | 4 | 4 | 30 | 30 | 30 | 4 | 4 | 4 | 4 | 4 | 30 | 30 |
| 5% PVA (g) | 80 | 80 | 80 | 80 | 80 | 260 | 255 | 260 | 80 | 80 | 80 | 85 | 85 | 240 | 240 |

TABLE 2

| | Example | | |
|---|---|---|---|
| | 6 | 7 | 8 |
| Dispersion H (rosin-modified phenol resin) | Tamanol 135 (produced by Arakawa Rinsan Co. | Tamanol 350 | Tamanol 145 |
| Dispersion I (terephthalic acid ester) | Dimethyl terephthalate | Diethyl terephthalate | Diphenyl terephthalate |

The heat-sensitive coatings for Examples 1–8 and Comparative Examples 1–7 prepared as described above were applied to paper bases having an areal weight of 50 to 53 g/m$^2$ so that the coating amount after drying was 5 g/m$^2$. After dried, they were allowed to pass through a super-calender to obtain heat-sensitive sheets having a Bekk smoothness (JIS (Japanese Industrial Standard) P-8119) of 150 to 250 seconds.

Results of quality tests for the heat-sensitive sheets in Examples 1–8 and Comparative Examples 1–7 are shown in Tables 3 and 4.

TABLE 3

| | *1 Whiteness (%) | *2 Print density | *3 Whiteness after heat-treatment (%) | *4 Image residual rate after heat-treatment (%) | *5 Fingerprint resisting property of image |
|---|---|---|---|---|---|
| Example | | | | | |
| 1 | 80.5 | 1.20 | 73.2 | 93 | A |
| 2 | 79.8 | 1.24 | 72.8 | 94 | A |
| 3 | 77.5 | 1.28 | 72.5 | 87 | B |
| 4 | 78.7 | 1.15 | 70.4 | 90 | A |
| 5 | 77.9 | 1.26 | 71.9 | 94 | A |
| Comparative Example | | | | | |
| 1 | 78.5 | 1.22 | 60.4 | 84 | C |
| 2 | 80.1 | 1.21 | 48.2 | 93 | B |
| 3 | 76.6 | 1.19 | 72.2 | 76 | C |
| 4 | 83.6 | 1.14 | 78.7 | 62 | C |
| 5 | 72.8 | 1.22 | 58.7 | 92 | C |

TABLE 4

| | | | | | Oil-resisting resi-*6 dual rate of image (1) | | | | Oil-resisting resi-*7 dual rate of image (2) | | |
|---|---|---|---|---|---|---|---|---|---|---|---|
| | White-*1 ness (%) | Print*2 density | Whiteness*3 after heat-treatment (%) | Image resi-*4 dual rate after heat-treatment (%) | Olive oil (%) | Gamellia oil (%) | Cotton seed oil (%) | Lard (%) | Kanabo Eroika hair liquid (%) | Shiseido Bravas hair cream oil (%) | Lion Vitalis V 7 (%) |
| Example | | | | | | | | | | | |
| 6 | 77.0 | 0.95 | 73.0 | 98 | 89 | 87 | 84 | 88 | 82 | 84 | 85 |
| 7 | 80.5 | 0.90 | 74.8 | 91 | 82 | 83 | 81 | 84 | 82 | 80 | 81 |
| 8 | 81.5 | 1.01 | 75.4 | 96 | 91 | 94 | 92 | 89 | 88 | 91 | 92 |
| Comparative Example | | | | | | | | | | | |
| 6 | 62.5 | 1.08 | 47.8 | 100 | 95 | 96 | 94 | 92 | 94 | 95 | 93 |

TABLE 4-continued

| | White-*1 ness (%) | Print*2 density | Whiteness*3 after heat-treatment (%) | Image resi-*4 dual rate after heat-treatment (%) | Oil-resisting resi-*6 dual rate of image (1) Olive oil (%) | Gamellia oil (%) | Cotton seed oil (%) | Lard (%) | Oil-resisting resi-*7 dual rate of image (2) Kanabo Eroika hair liquid (%) | Shiseido Bravas hair cream oil (%) | Lion Vitalis V 7 (%) |
|---|---|---|---|---|---|---|---|---|---|---|---|
| 7 | 83.2 | 0.84 | 81.5 | 28 | 11 | 18 | 9 | 21 | 24 | 13 | 8 |

*1Whiteness was determined by measuring brightness by Hunter according to JIS P-8123. As a filter, an Amber filter was used.
*2Print density was determined by printing with a facsimile test chart No. 2 by means of Xerox telecopier 495 and measuring the density of the full black part by Macbeth RD-514. (Wratten filter 106).
*3Whiteness after heat-treatment was determined by measuring the whiteness of the unrecorded heat-sensitive sheet in the same manner as in *1 after being allowed to stand in a chamber at 60° C. and humidity (RH) 30% for 24 hours.
*4Image residual rate after heat-treatment: Recording was carried out by Telecopier 495 to obtain a full black part and the density of it was measured by Macbeth RD-514 in the same manner as in *2 to obtain $D_1$. Then, the resulting recorded sample was allowed to stand at 60° C. and humidity (RH) 30% for 24 hours. The density of the sample after being allowed to so stand was measured by Macbeth RD-514 to obtain $D_2$. $D_2/D_1 \times 100$ was calculated as % to obtain the image residual rate.
*5Recording was carried out with a facsimile test chart No. 4 by Xerox Telecopier 495, and the image part of the recorded sample was brought into contact with the palm of the hand or fingers of ten persons several times. After being allowed to stand under an environment of 30° C. and RH 65% for 2 weeks, the degree of difficulty of reading the image was determined.
A: the state where the image is hardly different from that just after recording.
B: the state where the image can be easily read though fading is observed.
C: the state where fading of the image part is remarkable and the image can not be read.
*6Oil-resisting residual rate of image (1): Density $D_1$ was determined in the same manner as in *4. Then, an animal or vegetable oil was allowed to adhere to the image part of the recorded sample in a thickness of 2 μm. Namely, 0.2 cc of the animal or vegetable oil was weighed out and applied to a drum of an IGT ink kneading apparatus, and the rolls were revolved by the same operation as the ink kneading operation to uniformly apply the oil (corresponding to an oil membrane having 2 μm thickness on calculation). This oil membrane was transferred to the recorded sample by a rubber stamp, etc. Then, the recorded sample was allowed to stand in a chamber at 20° C. and humidity (RH) 65% for 10 days. After 10 days, the oil adhesion part of the recorded sample was measured by Macbeth RD-514 to obtain a density $D_3$. $D_3/D_1 \times 100$ was calculated as % to obtain an oil-resisting residual rate of image (1).
*7Oil-resisting residual rate of image (2): The same procedure as in *5 was carried out using available hair cosmetics as the oil (Kanebo Eroika hair liquid, Shiseido Bravas hair cream oil, and Lion Vitalis V7).

It is obvious from the results shown in Tables 3 and 4 that the heat-sensitive recording sheets of the present invention are remarkably excellent as compared with the recording sheets in the comparative examples.

While the invention has been described in detail and with reference to specific embodiment thereof, it will be apparent to one skilled in the art that various changes and modifications can be made therein without departing from the spirit and scope thereof.

What is claimed is:

1. A heat-sensitive recording sheet comprising a base having thereon a heat-sensitive recording layer which contains, as main components, a color former and a developer which causes coloration of said color former by heating, said color former is a mixture selected from the group consisting of:

(1) at least one of compounds (i) and (ii) as Component (A), and compound (iii) or (iv) as Component (B); and (2) compound (ii) as Component (A) and compounds (iii) and (iv) as Component (B)

said compound (i) being represented by the formula (I)

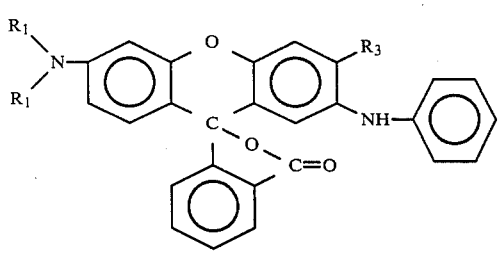

(I)

wherein $R_1$ represents a hydrogen atom, a methyl group, an ethyl group, a halogenated methyl group, a halogenated ethyl group, an alkoxyalkyl group, an acyloxyalkyl group, an allyl group, a propargyl group, a cyclohexyl group, an acetoxy group, a benzyl group which may be substituted by a lower alkyl group, a lower alkoxy group, a halogen atom or a nitro group, or a phenyl group which may be substituted by a lower alkyl group, a lower alkoxy group, a halogen atom or a nitro group, and $R_3$ represents a hydrogen atom, a lower alkyl group, an alkoxy group, an aryl group, a halogen atom, a halogenated lower alkyl group or an acetoxy group;

said compound (ii) being represented by the formula (II)

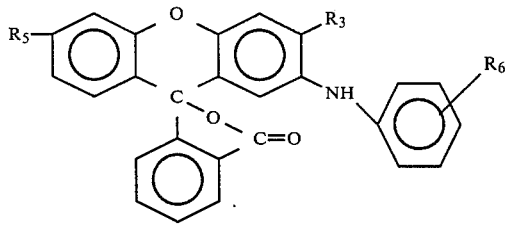

(II)

wherein $R_3$ represents the same meaning as defined above, $R_5$ represents a pyrrolidino group or a piperidino group, and $R_6$ represents a hydrogen atom, a lower alkyl group, an alkoxy group or a halogen atom;

said compound (iii) being represented by the formula (III)

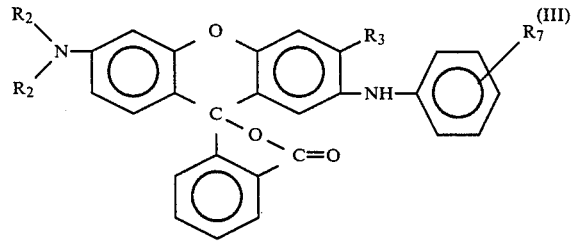

(III)

wherein $R_3$ represents the same meaning as defined above, $R_2$ represents a hydrogen atom, a lower alkyl group, a haloalkyl group, an alkoxyalkyl group, an acyloxyalkyl group, an alkoxy group, an allyl group, a propargyl group, a cyclohexyl group, a benzyl group which may be substituted by a lower alkyl group, a lower alkoxy group, a halogen atom or a nitro group, or a phenyl group which may be substituted by a lower alkyl group, a lower alkoxy group, a halogen atom or a nitro group, and $R_7$ represents a lower alkyl group, an alkoxy group or a halogen atom; and said compound (iv) being represented by the formula (IV)

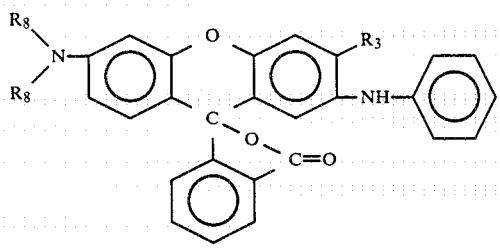

(IV)

wherein $R_3$ represents the same meaning as defined above, and $R_8$ represents an alkyl group having three or more carbon atoms or a halogenated alkyl group having three or more carbon atoms.

2. A heat-sensitive recording sheet according to claim 1, wherein the developer is at least one compound selected from the group consisting of p-hydroxybenzoic acid esters, phenolic compounds and mixtures thereof.

3. A heat-sensitive recording sheet according to claim 1, wherein the component (A) is contained in an amount of 1 to 50% by weight and the component (B) is contained in an amount of 50 to 99% by weight, based on the total amount of the color former.

4. A heat-sensitive recording sheet according to claim 1, wherein the heat-sensitive recording layer further contains at least one rosin-modified phenol resin and/or at least one terephthalic acid ester.

5. A heat-sensitive recording sheet according to claim 1, wherein the compound (i) is selected from the group consisting of 3-dimethylamino-7-anilinofluoran, 3-diethylamino-6-methyl-7-anilinofluoran, 3-dibenzylamino-6-chloro-7-anilinofluoran, 3-dicyclohexylamino-6-ethyl-7-anilinofluoran and 3-diacetoxyamino-6-bromo-7-anilinofluoran.

6. A heat-sensitive recording sheet according to claim 23, wherein the compound (ii) is selected from the group consisting of 3-pyrrolidino-6-methyl-7-anilinofluoran, 3-piperidino-6-methyl-7-anilinofluoran, 3-pyrrolidino-6-bromo-7-p-methylanilinofluoran and 3-piperidino-6-methoxy-7-p-chloroanilinofluoran.

7. A heat-sensitive recording sheet according to claim 1, wherein the compound (iii) is selected from the group consisting of 3-dimethylamino-6-chloroethyl-7-m-bromoanilinofluoran, 3-diethylamino-7-o-chloroanilinofluoran, 3-dicyclohexylamino-6-methyl-7-m-methylanilinofluoran and 3-diphenylamino-6-acetoxy-7-m-methoxyanilinofluoran.

8. A heat-sensitive recording sheet according to claim 1, wherein the compound (iv) is selected from the group consisting of 3-di-n-propylamino-7-anilinofluoran, 3-diisopropylamino-6-methyl-7-anilinofluoran, 3-di-n-butylamino-7-anilinofluoran, 3-diisobutylamino-6-bromo-7-anilinofluoran and 3-di-n-butylamino-6-methyl-7-anilinofluoran.

9. A heat-sensitive recording sheet according to claim 1, wherein the component (A) is selected from the group consisting of 3-dimethylamino-7-anilinofluoran, 3-diethylamino-6-methyl-7-anilinofluoran, 3-dibenzylamino-6-chloro-7-anilinofluoran, 3-dicyclohexylamino-6-ethyl-7-anilinofluoran, 3-diacetoxyamino-6-bromo-7-anilinofluoran, 3-pyrrolidino-6-methyl-7-anilinofluoran, 3-piperidino-6-methyl-7-anilinofluoran, 3-pyrrolidino-6-bromo-7-p-methylanilinofluoran and 3-piperidino-6-methoxy-7-p-chloroanilinofluoran; and the component (B) is selected from the group consisting of 3-dimethylamino-6-chloroethyl-7-m-bromoanilinofluoran, 3-diethylamino-7-o-chloroanilinofluoran, 3-dicyclohexylamino-6-methyl-7-m-methylanilinofluoran, 3-diphenylamino-6-acetoxy-7-m-methoxyanilinofluoran, 3-di-n-propylamino-7-anilinofluoran, 3-diisopropylamino-6-methyl-7-anilinofluoran, 3-di-n-butylamino-7-anilinofluoran, 3-diisobutylamino-6-bromo-7-anilinofluoran and 3-di-n-butylamino-6-methyl-7-anilinofluoran.

10. A heat-sensitive recording sheet according to claim 1, wherein component (B) is at least one compound selected from the group consisting of compounds represented by the formula (IV)

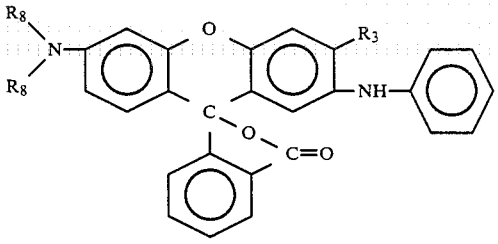

(IV)

wherein $R_3$ represents a hydrogen atom, a lower alkyl group, an alkoxy group, an aryl group, a halogen atom, a halogenated lower alkyl group or an acetoxy group, and $R_8$ represents an alkyl group having three or more carbon atoms or a halogenated alkyl group having three or more carbon atoms.

11. A heat-sensitive recording sheet comprising a base having thereon a heat-sensitive recording layer which contains, as main components, a color former and a developer which causes coloration of said color former by heating, said color former is a mixture selected from the group consisting of (1) compound (i) as Component (A), at least one of compounds (iii) and (iv) as Component (B), and compound (V) as Component (C); and (2) compound (ii) as Component (A), compound (iv) as Component (B), and compound (v) as Component (C)

said compound (i) being represented by the formula (I)

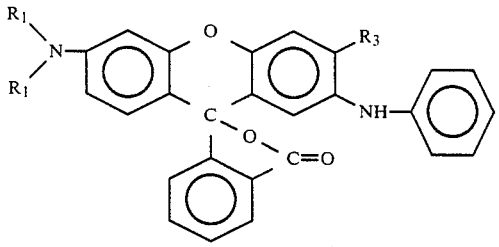

(I)

wherein $R_1$ represents a hydrogen atom, a methyl group, an ethyl group, a halogenated methyl group, a halogenated ethyl group, an alkoxyalkyl group, an acyloxyalkyl group, an allyl group, a propargyl group, a cyclohexyl group, an acetoxy group, a benzyl group which may be substituted by a lower alkyl group, a lower alkoxy group, a halogen atom or a nitro group, or a phenyl group which may be substituted by a lower alkyl group, a lower alkoxy group, a halogen atom or a nitro group, and $R_3$ represents a hydrogen atom, a lower alkyl group, an alkoxy group, an aryl group, a halogen atom, a halogenated lower alkyl group or an acetoxy group;

said compound (ii) being represented by the formula (II)

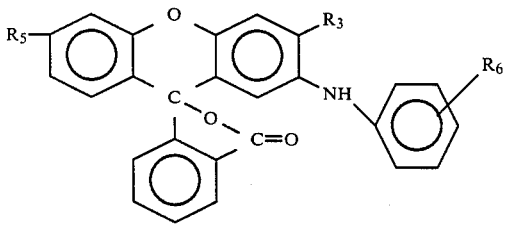

(II)

wherein $R_3$ represents the same meaning as defined above, $R_5$ represents a pyrrolidino group or a piperidino group, and $R_6$ represents a hydrogen atom, a lower alkyl group, an alkoxy group or a halogen atom;

said compound (iii) being represented by the formula (III)

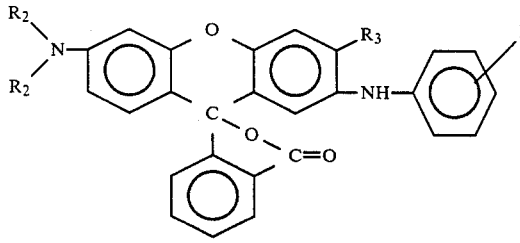

(III)

wherein $R_3$ represents the same meaning as defined above, $R_2$ represents a hydrogen atom, a lower alkyl group, a haloalkyl group, an alkoxyalkyl group, an acyloxyalkyl group, an alkoxy group, an allyl group, a propargyl group, a cyclohexyl group, a benzyl group which may be substituted by a lower alkyl group, a lower alkoxy group, a halogen atom or a nitro group, or a phenyl group which may be substituted by a lower alkyl group, a lower alkoxy group, a halogen atom or a nitro group, and $R_7$ represents a lower alkyl group, an alkoxy group or a halogen atom;

said compound (iv) being represented by the formula (IV)

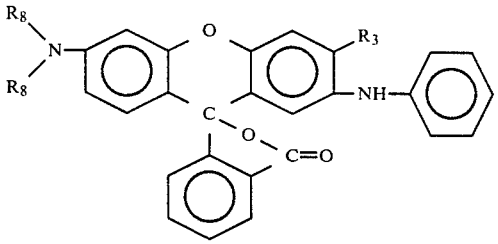

(IV)

wherein $R_3$ represents the same meaning as defined above, and $R_8$ represents an alkyl group having three or more carbon atoms or a halogenated alkyl group having three or more carbon atoms; and said compounds (v) being represented by the formula (V)

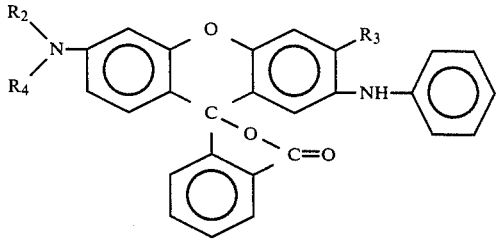

(V)

wherein $R_2$ and $R_3$ represent the same meanings as defined above, $R_4$ represents a substituent selected from the group as described in $R_2$, but is a substituent different than the $R_2$ substituent.

12. A heat-sensitive recording sheet according to claim 11, wherein the developer is at least one compound selected from the group consisting of p-hydroxybenzoic acid esters, phenolic compounds and mixtures thereof.

13. A heat-sensitive recording sheet according to claim 11, wherein the component (A) is contained in an amount of 30 to 90% by weight, the component (B) is contained in an amount of 2.5 to 30% by weight, and the component (C) is contained in an amount of 2.5 to 40% by weight, based on the total amount of the color former.

14. A heat-sensitive recording sheet according to claim 11, wherein the heat-sensitive recording layer further contains at least one rosin-modified phenol resin and/or at least one terephthalic acid ester.

15. A heat-sensitive recording sheet according to claim 11, wherein the compound (i) is selected from the group consisting of 3-dimethylamino-7-anilinofluoran, 3-diethylamino-6-methyl-7-anilinofluoran, 3-dibenzylamino-6-chloro-7-anilinofluoran, 3-dicyclohexylamino-6-ethyl-7-anilinofluoran and 3-diacetoxyamino-6-bromo-7-anilinofluoran.

16. A heat-sensitive recording sheet according to claim 11, wherein the compound (ii) is selected from the group consisting of 3-pyrrolidino-6-methyl-7-anilinofluoran, 3-piperidino-6-methyl-7-anilinofluoran, 3-pyrrolidino-6-bromo-7-p-methylanilinofluoran and 3-piperidino-6-methoxy-7-p-chloroanilinofluoran.

17. A heat-sensitive recording sheet according to claim 11, wherein the compound (iii) is selected from the group consisting of 3-dimethylamino-6-chloroethyl-7-m-bromoanilinofluoran, 3-diethylamino-7-o-chloroanilinofluoran, di-dicyclohexylamino-6-methyl-7-m-methylanilinofluoran and 3-diphenylamino-6-acetoxy-7-m-methoxyanilinofluoran.

18. A heat-sensitive recording sheet according to claim 11, wherein the compound (iv) is selected from the group consisting of 3-di-n-propylamino-7-anilinofluoran, 3-diisopropylamino-6-methyl-7-anilinofluoran, 3-di-n-butylamino-7-anilinofluoran, 3-diisobutylamino-6-bromo-7-anilinofluoran and 3-di-n-butylamino-6-methyl-7-anilinofluoran.

19. A heat-sensitive recording sheet according to claim 11, wherein the compound (v) is selected from the group consisting of 3-methylethylamino-6-chloro-7-anilinofluoran, 3-methylcyclohexylamino-6-methyl-7-anilinofluoran, 3-ethoxypropylamino-6-methoxy-7-anilinofluoran, 3-m-chlorobenzylmethylamino-6-phenyl-7-anilinofluoran and 3-p-nitrophenylamino-6-chloromethyl-7-anilinofluoran.

20. A heat-sensitive recording sheet according to claim 11, wherein the component (A) is selected from the group consisting of 3-dimethylamino-7-anilinofluoran, 3-diethylamino-6-methyl-7-anilinofluoran, 3-dibenzylamino-6-chloro-7-anilinofluoran, 3-dicyclohexylamino-6-ethyl-7-anilinofluoran, 3-diacetoxyamino-6-bromo-7-anilinofluoran, 3-pyrrolidino-6-methyl-7-anilinofluoran, 3-piperidino-6-methyl-7-anilinofluoran, 3-pyrrolidino-6-bromo-7-p-methylanilinofluoran and 3-piperidino-6-methoxy-7-p-chloroanilinofluoran; the component (B) is selected from the group consisting of 3-dimethylamino-6-chloroethyl-7-m-bromoanilinofluoran, 3-diethylamino-7-o-chloroanilinofluoran, 3-dicyclohexylamino-6-methyl-7-m-methylanilinofluoran, 3-diphenylamino-6-acetoxy-7-m-methoxyanilinofluoran, 3-di-n-propylamino-7-anilinofluoran, 3-diisopropylamino-6-methyl-7-anilinofluoran, 3-di-n-butylamino-7-anilinofluoran, 3-diisobutylamino-6-bromo-7-anilinofluoran and 3-di-n-butylamino-6-methyl-7-anilinofluoran; and the component (C) is selected from the group consisting of 3-methylethylamino-6-chloro-7-anilinofluoran, 3-methylcyclohexylamino-6-methyl-7-anilinofluoran, 3-ethoxypropylamino-6-methoxy-7-anilinofluoran, 3-m-chlorobenzylmethylamino-6-phenyl-7-anilinofluoran and 3-p-nitrophenylamino-6-chloromethyl-7-anilinofluorane.

21. A heat-sensitive recording sheet according to claim 11, wherein component (B) is at least one compound selected from the group consisting of compounds represented by the formula (IV)

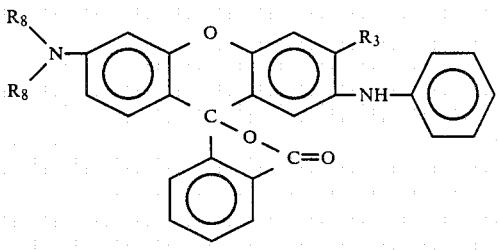

(IV)

wherein $R_3$ represents a hydrogen atom, a lower alkyl group, an alkoxy group, an aryl group, a halogen atom, a halogenated lower alkyl group or an acetoxy group, and $R_8$ represents an alkyl group having three or more carbon atoms or a halogenated alkyl group having three or more carbon atoms.

* * * * *